US007293512B2

(12) United States Patent
Tajima et al.

(10) Patent No.: US 7,293,512 B2
(45) Date of Patent: Nov. 13, 2007

(54) SEQUIN SEWING APPARATUS

(75) Inventors: Ikuo Tajima, Kasugai (JP); Naohito Miyazaki, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 10/567,140

(22) PCT Filed: Aug. 6, 2004

(86) PCT No.: PCT/JP2004/011361

§ 371 (c)(1),
(2), (4) Date: Feb. 6, 2006

(87) PCT Pub. No.: WO2005/014907

PCT Pub. Date: Feb. 17, 2005

(65) Prior Publication Data

US 2006/0254484 A1 Nov. 16, 2006

(30) Foreign Application Priority Data

Aug. 7, 2003 (JP) ..... 2003-289249

(51) Int. Cl.
*D05B 3/12* (2006.01)
*D05B 27/00* (2006.01)

(52) U.S. Cl. ..... 112/106; 112/99

(58) Field of Classification Search ..... 112/98, 112/99, 104, 113, 404, 439, 258, 259; 223/44, 223/46, 48; 428/66.5
See application file for complete search history.

(56) References Cited

U.S. PATENT DOCUMENTS

| | | | | | |
|---|---|---|---|---|---|
| 700,305 | A | * | 5/1902 | Cornely | 112/99 |
| 797,308 | A | * | 8/1905 | Nassberg | 112/99 |
| 1,107,599 | A | * | 8/1914 | Fink | 112/99 |
| 2,436,759 | A | * | 12/1948 | Mueller | 223/48 |

(Continued)

FOREIGN PATENT DOCUMENTS

DE 92 09 764.2 9/1992

(Continued)

OTHER PUBLICATIONS

Relevant portion of International Search Report of corresponding PCT Application PCT/JP2004/011361.

*Primary Examiner*—Ismael Izaguirre
(74) *Attorney, Agent, or Firm*—Rossi, Kimms & McDowell LLP

(57) ABSTRACT

A feeding mechanism (6) feeds a plurality of continuous sequin strips (3, 60), which are supplied in an overlapped state, a predetermined pitch at a time to a sewing mechanism (2, 31, 32, 41, 50, 51) while keeping the continuous sequin strips in the overlapped state. The sewing mechanism sews leading sequins (S, S2) of the respective continuous sequin strips together in the overlapped state onto a sewn-to member. A cutting mechanism (27, 30) cuts the sequins sewn at the same time in the overlapped state. For example, a plurality of continuous sequin strips let out from a plurality of reels (5, 61) housing the respective continuous sequin strips are overlapped via a lead-in section (63), so that the plurality of continuous sequin strips (3, 60) are supplied in the overlapped state. As a result, a highly decorative sequin sewn member in which a plurality of sequins are overlapped can be produced with ease.

11 Claims, 8 Drawing Sheets

U.S. PATENT DOCUMENTS

| | | | | |
|---|---|---|---|---|
| 3,390,650 | A * | 7/1968 | Ochsner | 112/88 |
| 4,952,436 | A * | 8/1990 | Ruschmann | 428/66.5 |
| 5,755,168 | A | 5/1998 | Gunther et al. | |
| 7,082,884 | B2 * | 8/2006 | Tajima et al. | 112/99 |

FOREIGN PATENT DOCUMENTS

| | | | |
|---|---|---|---|
| JP | 63-47818 | B2 | 9/1988 |
| JP | 2-13495 | A | 1/1990 |
| JP | 3-68146 | B2 | 10/1991 |
| JP | 6-4927 | B2 | 1/1994 |
| JP | 2732869 | B2 | 12/1997 |
| WO | WO 03/064749 | A1 | 8/2003 |
| WO | WO 2004/046445 | A1 | 6/2004 |

* cited by examiner

SEQUIN SEWING APPARATUS

This application is a U.S. National Phase Application of PCT International Application PCT/JP2004/011361 filed on Aug. 6, 2004.

TECHNICAL FIELD

The present invention relates to a sequin sawing apparatus which sews sequins onto a sewn-to member while severing the sequins from a strip of continuously-connected sequins, and more particularly to a sequin sewing apparatus which is capable of sewing a plurality of sequins in an overlapped state to a sewn-to member.

BACKGROUND ART

Conventionally, there has been known a sequin sewing apparatus (also referred to as a spangle sewing machine) which fixes sequins or small annular pieces called spangles to a cloth (sewn-to member) so as to decorate the cloth. Examples of the conventional sequin sewing apparatus are disclosed in Patent Publications 1 and 2 stated below. In such a sequin sewing apparatus, a strip of a multiplicity of continuously-connected sequins (spangles) is played out or let out from a reel, having the continuous sequin strip wound thereon, and then the continuous sequin strip is fed out, through feeding operation of a suitable feeding mechanism, at a predetermined pitch corresponding to the size of one sequin. One sequin is sewn onto a sewn-to member while being severed from the continuous sequin strip having been fed in the interlocked relation to sewing operation by a needle bar of the sewing machine. With the above conventional sequin sewing apparatus, the continuous sequin strip is fed by means of a feed roller having a multiplicity of projections on its outer periphery.

Patent Publication 1: Japanese Laid-Open Patent Publication (Kokai) No. H02-13495

Patent Publication 2: Japanese Patent No. 2732869

Conventionally, to make a sequin sewn member more decorative, various devices have been made, such as shaping sequins in arbitrary forms such a petal shape, and changing the size of sequins such as making sequins smaller. With the above conventional sequin sewing apparatus, however, there has been the problem that only one sequin can be sewn to one place of a sewn-to member, and hence only by making the above-mentioned devices, a sequin sewn member can be made decorative only to a limited extent.

DISCLOSURE OF THE INVENTION

In view of the foregoing, it is an object of the present invention to provide a sequin sewing apparatus which is capable of sewing a plurality of sequins in an overlapped state to a sewn-to member to thereby produce a highly decorative sequin sewn member.

The present invention provides a sequin sewing apparatus A sequin sewing apparatus, which comprises: a supplying section that supplies a plurality of continuous sequin strips, comprising a multiplicity of continuously-connected sequins, in an overlapped state; a feeding mechanism that feeds the plurality of continuous sequin strips supplied in the overlapped state by the supplying section a predetermined pitch at a time in interlocked relation to predetermined sewing operation; a sewing mechanism that sews leading sequins of the plurality of continuous sequin strips, having been fed by the feeding mechanism, together in the overlapped state onto a sewn-to member; and a cutting mechanism that cuts off the leading plurality of sequins sewn by the sewing mechanism from the respective continuous sequin strips.

With the above arrangement, the feeding mechanism feeds a plurality of continuous sequin strips, which are supplied in an overlapped state, a predetermined pitch at a time to the sewing mechanism while keeping the continuous sequin strips in the overlapped state. Therefore, the sewing mechanism sews a plurality of leading sequins of the respective continuous sequin strips together in an overlapped state onto a sewn-to member, and the cutting mechanism cuts the plurality of sequins sewn in the overlapped state onto the sewn-to member at the same time. By sewing a plurality of sequins in an overlapped state in this way, a highly decorative sequin sewn member can be produced with ease. For example, only by suitably changing shapes, colors, etc. of sequins to be overlapped, it is possible to produce a highly decorative sequin sewn member, and therefore it is possible to provide a novel sequin sewing apparatus.

BEST MODE FOR CARRYING OUT THE INVENTION

An embodiment of the present invention will now be described in detail with reference to the accompanying drawings.

Figure 1:
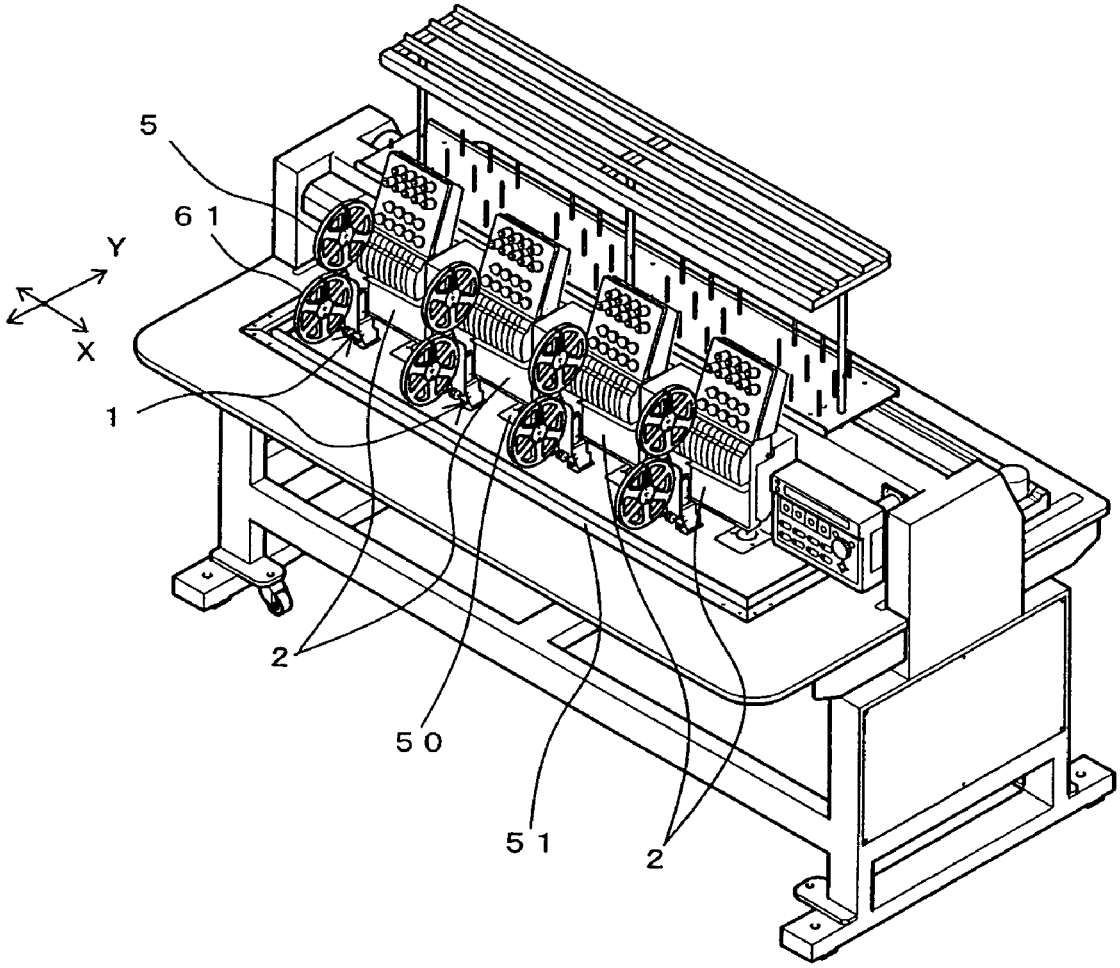
FIG. 1 is a perspective view showing the appearance of an embodiment of an embroidering machine equipped with a sequin sewing apparatus in accordance with the present invention.

FIG. 1 is a view showing the appearance of a sequin sewing apparatus according to an embodiment of the present invention. The sequin sewing apparatus (hereinafter also merely referred to as "the embroidering machine") according to the embodiment employs a four-headed embroidering machine equipped with four sewing machine heads. As conventionally known in the art, in the embroidering machine, needle bar cases 2 are provided in corresponding relation to the respective sewing machine heads, a throat plate 50 is disposed under the needle bar of each of the machine heads, and an embroidery frame 51 holding a sewn-to member is disposed between the needle bar cases 2 and the throat plates 50. The sequin sewing apparatus according to the present embodiment is constructed by attaching a sequin sewing unit 1 to the embroidering machine. The sequin sewing unit 1 is attached to the left side and/or right side of each of the needle bar cases 2; in the present embodiment, the sequin sewing unit 1 is attached to only the left side of the associated needle bar case 2. The sequin sewing unit 1 is equipped with two reels 5 and 61 for winding a strip of continuously-connected sequins thereon, and two continuous sequin strips wound around the reels 5 and 61 are overlapped and fed out by a sequin feeding apparatus (described later). Each of the needle bar cases 2 is a multi-needle structure, and, in the case where the sequin sewing unit 1 is attached to only the left side of the associated needle bar case 2 as in the present embodiment, the leftmost needle in the needle bar case 2 is used as a sequin sewing needle. As conventionally known in the art, the embroidery frame 51 is driven in left-and-right (X) and front-and-rear (Y) directions in accordance with sewing data.

Figure 2:
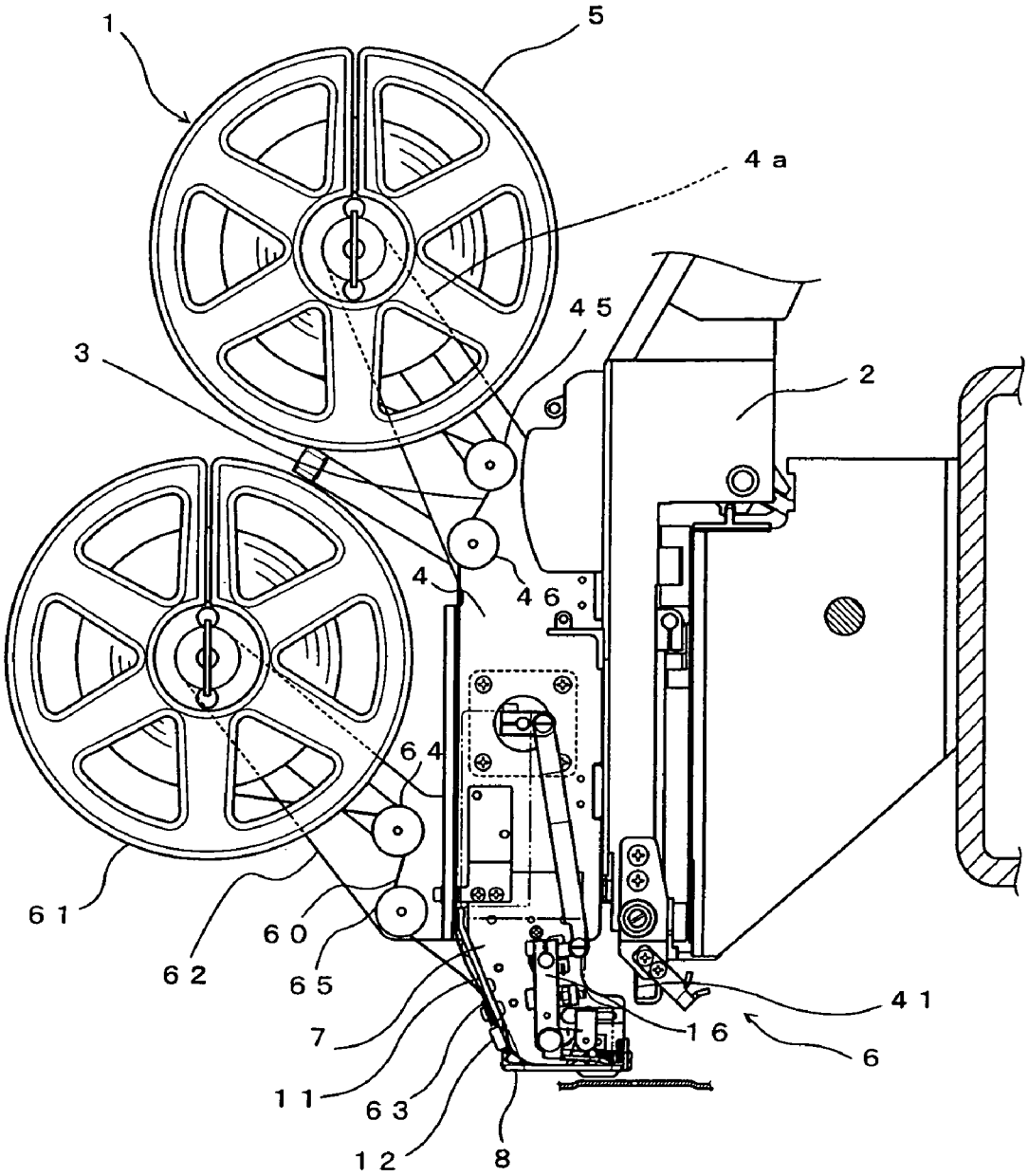
FIG. 2 is a side view showing in enlarged scale a portion of a sequin sewing unit in the embodiment.
Figure 3:
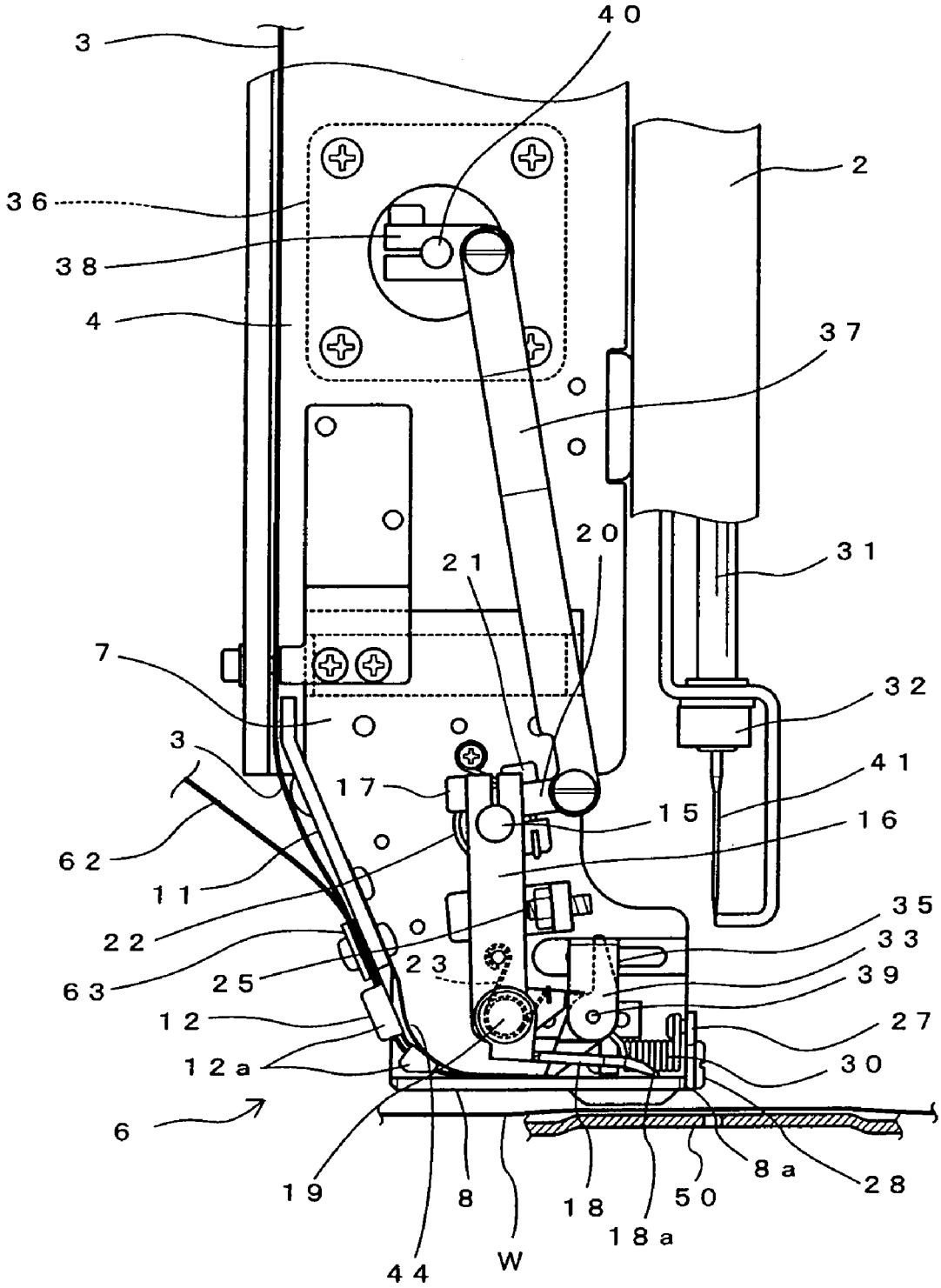
FIG. 3 is a side view showing in further enlarged scale a portion of the sequin sewing unit in the embodiment.
Figure 4:
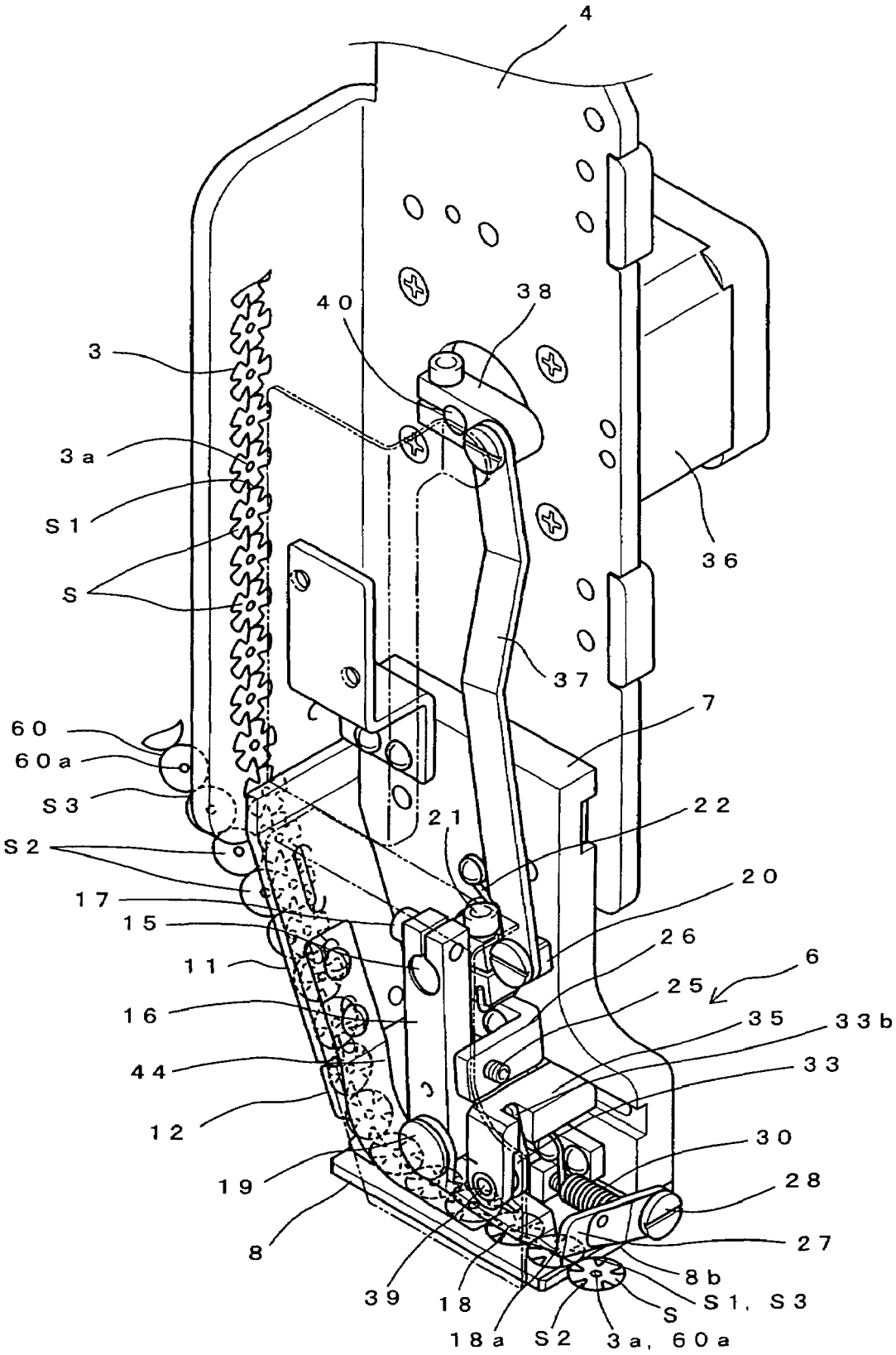
FIG. 4 is a perspective view of the portion of the sequin sewing apparatus shown in FIG. 3; and, FIG. 5 is a perspective view showing, in further enlarged scale and with parts taken away, principal sections of the sequin sewing apparatus shown in FIG. 4.
Figure 5:
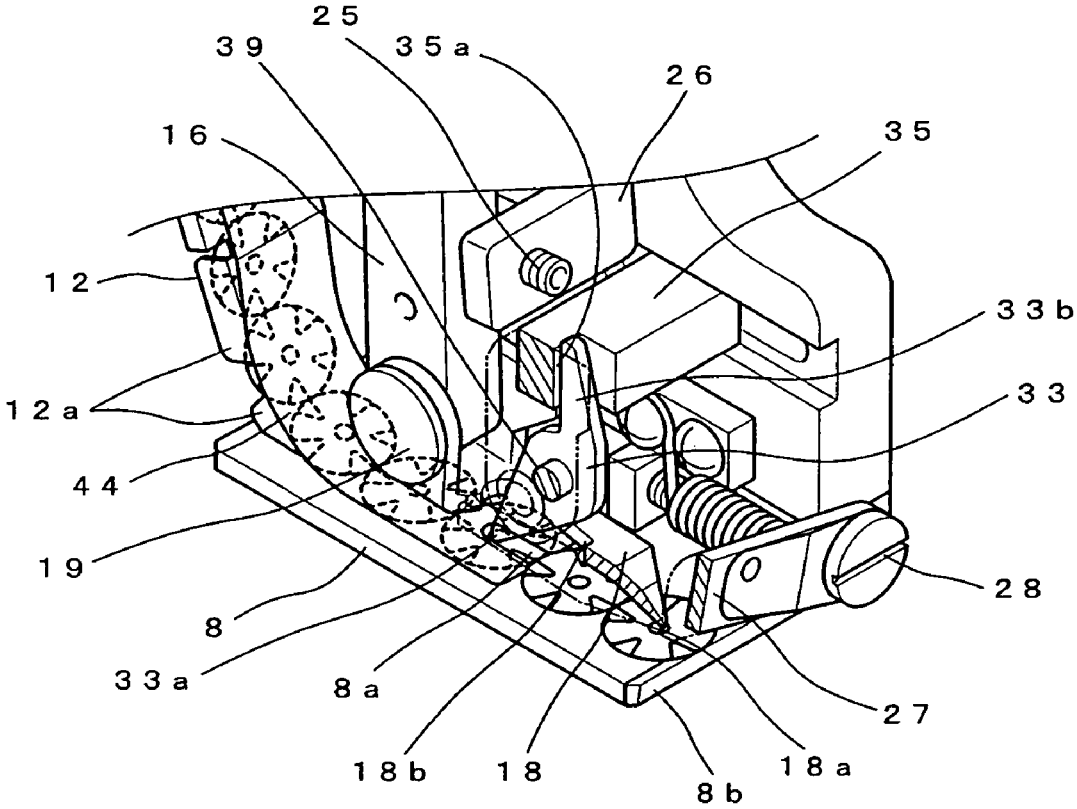

FIG. 2 is a side view showing in enlarged scale a portion of the sequin sewing unit 1, FIG. 3 is a side view showing in further enlarged scale a portion of a sequin feeding apparatus 6 in the sequin sewing unit 1, FIG. 4 is a perspective view of the portion of the sequin feeding apparatus 6, and FIG. 5 is a perspective view showing, in further enlarged scale and with parts taken away, principal sections of the sequin feeding apparatus 6.

As illustrated in FIG. 2, the sequin sewing unit 1 is constructed such that the reel 5, which has a strip of continuously-connected sequins 3 wound thereon and is supported on a supporting base 4*a*, and the reel 61, which has a strip of continuously-connected sequins 60 wound thereon and is supported on a supporting base 62, are supported on a mounting base 4, and the sequin feeding apparatus 6 is also supported on the mounting base 4. The mounting base 4 is attached to the needle bar case 2 via a link mechanism, not shown, in such a manner that it can ascend and descend relative to the needle bar case 2. In FIGS. 2 and 3, the mounting base 4 is shown as being in a descended position and in a posture where sewing of sequins is permitted. On the other hand, when sewing of sequins is not to be performed, the mounting base 4 is evacuated to an ascended position so as not to hinder the normal embroidering operation. In the individual machine heads, the mounting bases 4 are driven to ascend or descend concurrently via air cylinders, not shown. Where the embroidering machine has a small number of machine heads, i.e., just one machine head, the mounting base (or bases) 4 may be caused to ascend or descend manually.

The reel 5 having the continuous sequin strip 3 wound thereon is supported rotatably and removably on an upper end portion of the supporting base 4*a* formed on an upper portion of the mounting base 4. The continuous sequin strip 3 is comprised of a multiplicity of continuously-connected sequins having an arbitrary or desired first shape, and is formed by die-cutting a long synthetic resin film of a given width in such a manner that a multiplicity of petal-shaped sequins S are continuously connected via connecting portions S1 in the illustrated example. Each of the sequins S has a hole 3*a* formed in its center (see FIG. 4). On the other hand, the reel 65 having the continuous sequin strip 60 wound thereon is supported rotatably and removably on an upper end portion of the supporting base 62 formed on a lower portion of the mounting base 4*a* of the mounting base 4. The continuous sequin strip 60 as well is comprised of a multiplicity of continuously-connected sequins with an arbitrary or desired second shape, and is formed by die-cutting a long synthetic resin film of a given width in such a manner that a multiplicity of circular sequins S2 are continuously connected via connecting portions S3 in the illustrated example. Each of the sequins S2 has a hole 60*a* formed in its center (see FIG. 4). The hole 3*a* is formed in the center of each sequin 3*a* and the hole 60*a* is formed in the center of each sequin S2 in such a manner that the holes 3*a* and 60*a* substantially correspond to each other when the sequins S and S2 are overlapped. The holes 3*a* and 60*a* are holes through which needles (threads) are passed, and each of the holes 3*a* and 60*a* should not necessarily be formed in the center of the corresponding sequin, but the positions of the holes 3*a* and 60*a* of the corresponding overlapped sequins have to correspond to each other. Note that a plurality of holes may be formed in one sequin, and in this case, in a multiplicity of overlapped sequins, at least the positions of holes through which needles (threads) are passed may correspond to each other.

The reel 61 may be juxtaposed to the upper reel 5 and supported on the arm portion 4*a* of the mounting base 4.

Next, an example structure of the sequin feeding apparatus 6 will be explained in detail. The sequin feeding apparatus 6 is secured to a support plate 7 that is in turn attached to a lower portion of the mounting base 4. The support plate 7 has a horizontal sequin supporting plate 8 formed on its lower end for supporting sequins thereon. Portion of the continuous sequin strip 60, played out or let out from the lower reel 61, is led onto the supporting plate 8 by way of a lead-in section 63 and a guide section 12 provided on a rear surface of a bracket 11 via a tension roller 64 and an orientation roller 65 and then delivered rearward as viewed from the front of the embroidering machine. On the other hand, portion of the continuous sequin strip 3, played out or let out from the upper reel 5, is directed downward along the mounting base 4 via a tension roller 45 and an orientation roller 46, led to the lead-in section provided on the rear surface of the bracket 11, overlapped with the continuous sequin strip 60 let out from the lower reel 61, led onto the supporting plate 8 by way of the guide section 12, and then delivered rearward as viewed from the front of the embroidery machine. The lead-in section 63 leads the continuous sequin strips 3 and 60 to the guide section 12 so as to prevent the continuous sequin strips 3 and 60 from being separated from the bracket 11. Note that, in the following description about the sequin sewing unit 1, the terms "forward" and "reward" are used to refer to directions opposite to forward and rearward directions of the embroidery machine. Namely, the direction in which sequins are fed forward (i.e., in a rearward direction as viewed from the front of the embroidering machine) will hereinafter referred to as "forward direction."

Figure 6:
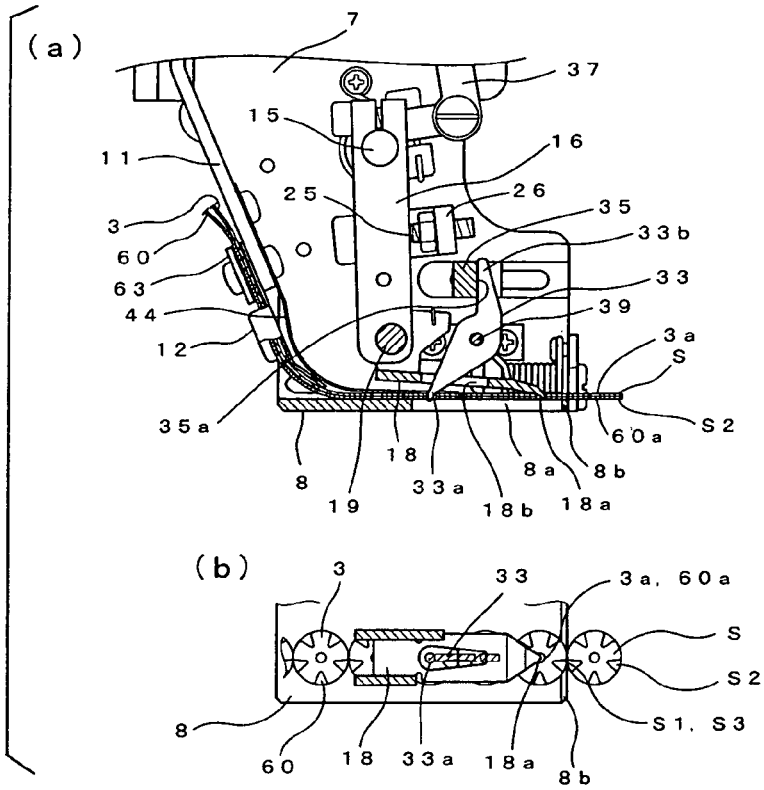
FIG. 6 is a partly-sectional side view and schematic plan view showing the principal sections of the sequin sewing apparatus when one sequin feeding cycle has been completed by a feed lever having moved to its forwardmost position.

The supporting plate 8 has a slit 8*a* with a predetermined length and an appropriate width formed therein to extend in the front-and-rear direction (Y direction) from a front position to a middle position of the supporting plate 8 (see FIG. 6(*a*)). Adjusting the position of the guide section 12 in the left-and-right direction (X direction) thereof can properly position the center hole 3*a* of each predetermined sequin 3 and the center hole 60*a* of each predetermined sequin S2 immediately over the slit 8*a* in a manner corresponding to each other. Namely, the guide section 12 provided on the rear surface of the bracket 11 is provided for properly registering the center hole 3*a* of each predetermined sequin 3 of the continuous sequin strip 3 and the center hole 60*a* of each predetermined sequin S2 of the continuous sequin strip 60 with the slit 8*a*, but not for properly positioning the continuous sequin strips 3 and 60 on the supporting plate 8. As will be described later, the slit 8*a* of the supporting plate 8 is provided to allow a distal-end hook portion 18*a* of a feed lever 18 and a distal-end engaging claw 33*a* of a lock lever 33 to pass through the center holes 3*a* of the sequins S and the center holes 60*a* of the sequins S2 on the supporting plate 8 as the distal-end hook portion and engaging claw 18*a* and 33*a* engage with the center holes 3*a* and 60*a*. Thus, in the sequin sewing apparatus, the continuous sequin strips 3 and 60 are overlapped in such a manner that the distal-end hook portion 18*a* of the feed lever 18 and the distal-end engaging claw 33*a* of the lock lever 33 engage with the center holes 3*a* of the sequins S and the center holes 60*a* of the sequins S2.

As shown in FIG. 3 or 4, a pivot shaft 15 is pivotally supported on a middle portion of the support plate 7 with the axial centerline of the pivot shaft 15 extending in the left-and-right direction (X direction). A pivot arm 16 is fixed via a screw 17 to the pivot shaft 15, and the feed lever 18 having the distal-end hook portion 18*a* is pivotably supported, via a shaft 19, on a free end portion of the pivot arm 16. Further, a follower lever 20 is fixed via a screw 21 to the pivot shaft 15 adjacent to the pivot arm 16. Consequently, the follower lever 20 and the pivot arm 16 are connected together to provide a bellcrank-like structure.

A torsion spring 22 fitted around the pivot shaft 15 has one end secured to the support plate 7 and the other end held on the follower lever 20, via which the pivot arm 16 is biased in a counterclockwise direction as viewed in FIG. 3. Further, a torsion spring 23 fitted around the shaft 19 has one end secured to the pivot art 16 and the other end held on the feed lever 18, via which the feed lever 18 is biased in a clockwise direction. Therefore, the distal-end hook portion 18*a* of the feed lever 18 is normally biased toward the supporting plate 8.

The feed lever 18 functions to sequentially feed the overlapped continuous sequin strips 3 and 60 in the forward direction a predetermined pitch at a time by being moved forward with the distal-end hook portion 18*a* engaging the center hole 3*a* of one sequin S of the continuous sequin strip 3 and the center hole 60*a* of one sequin S2 of the continuous sequin strip 60, which are placed in an overlapped state on the supporting plate 8. As will be described later in detail, the feed lever 18 is moved forward and rearward in response to pivotal movement of the pivot arm 16 so as to sequentially feed the continuous sequin strips 3 and 60 forward at a predetermined pitch at the same time. The pivot arm 16 and a mechanism for pivoting the pivot arm 16 together constitute a feeding mechanism for pivotally moving the feed lever 18 forward and rearward. The follower lever 20 integrally connected with the pivot arm 16 has a free end connected to a free end of a driving lever 38 via a connection link 37. The driving lever 38 is fixedly connected to an output shaft 40 of a motor 36 that is secured to a left side surface of the mounting base 4. By the motor 36 driving the driving lever 38 to reciprocatively pivot through a predetermined angular range, the overlapped continuous sequin strips 3 and 60 can be fed. In this way, when the sequin feeding apparatus 6 is driven, the continuous sequin strips 3 and 60 are fed together a predetermined pitch in the overlapped state. It should be noted that the sequin feeding operation by the motor 36 is carried out in tact operation in interlocked relation to predetermined sewing operation. Namely, the sequin feeding apparatus 6 feeds the continuous sequin strips 3 and 60 a predetermined pitch in synchronization with the timing of sewing of one sequin. For example, the feeding lever 18 is moved forward a predetermined pitch immediately before sewing of the leading sequin is started, and the feeding lever 18 is moved rearward before the sewing (typically comprised of a plurality of needling steps as will be described later) of the leading sequin is completed.

The pivot arm 16 biased in the counterclockwise direction is held in a posture as illustrated in FIGS. 3, 4 and 6 by abutting against a stopper 25 provided on the support plate 7. This posture is taken when the feeding of the overlapped continuous sequin strips 3 and 60 has been completed. FIG. 6(*a*) is a partly-sectional side view showing in enlarged scale of relevant portions of the sequin feeding apparatus 6 having completed the feeding of the overlapped continuous sequin strips 3 and 60, and FIG. 6(*b*) is a plan view schematically showing the sequin feeding apparatus 6 having completed the feeding of the overlapped continuous sequin strips 3 and 60. Namely, when the feeding of the overlapped continuous sequin strips 3 and 60 has been completed, the hook portion 18*a* of the feeding lever 18 engages both the center hole 3*a* of the second sequin S from the leading sequin of the continuous sequin strip 3 and the center hole 60*a* of the second sequin S2 from the leading sequin of the continuous sequin strip 60, and the connecting portion S1 between the leading and second sequins S and the connection portion S3 between the leading and second sequins S2 are positioned immediately above a fixed cutter blade 8*b* provided on a front end edge of the supporting plate 8.

The stopper 25 is formed of a threaded rod screwed to a bracket 26 secured to the support plate 7, and the pivot arm 16 abuts against the rear end of the stopper 25. The threaded rod can be locked by screwing up a nut.

A movable cutter blade 27 is pivotably supported via a pin 28 on a lower end portion of the support plate 7 and is normally held, via a torsion spring 30, in a retracted or evacuated position spaced upward from the fixed cutter blade 8*b*. As a needle bar 31 descends, the movable cutter blade 27 is pressed by a needle clamp 32 at the lower end of the needle bar 31. By being thus pressed by the needle clamp 32, the movable cutter blade 27 pivots against the resilient force of the torsion spring 30 to cut the connecting portion S1 of the sequins S and the connecting portion S3 of the sequins S2 in conjunction with the fixed cutter blade 8*b*. As the needle clamp 32 ascends along with the needle bar 31, the movable cutter blade 27 returns to the retracted position by the resilient force of the torsion spring 30.

The guide section 12 for directing the continuous sequin strips 3 and 60 onto the supporting plate 8 is replaceable with another one depending on the widths of the set continuous sequin strips 3 and 60, and is comprised of two guide members 12*a*, each of which is made by bending a plate into a channel-like sectional shape. The distance between opposed side walls of each of the guide members 12*a* is set to be slightly greater than the width of each sequin S and each sequin S2. A holding member 44 is disposed in front of the bracket 11 having the guide section 12 attached thereto. The holding member 44 is formed of a resilient plate, such as a spring steel plate, which has a width equal to or slightly greater than the width of the sequin S and the sequin S2 and has a predetermined length. The holding member 44 has one end portion secured to the bracket 11 and another end portion resiliently abutted against the upper surface of the supporting plate 8. The holding member 44 is recessed in its end edge portion corresponding in position to the slit 8*a* of the supporting plate 8, so as not to close the slit 8*a* (see FIG. 5). The continuous sequin strips 3 and 60, delivered from the guide section 12, are passed between the supporting plate 8 and the holding member 44 resiliently abutted against the upper surface of the supporting plate 8.

Next, a description will be given of the lock lever 33 disposed above the feed lever 18 and a mechanism for driving the lock lever 33.

As shown in FIG. 5, the lock lever 33 has the engaging claw 33*a* at the tip of its one end portion and a stopper portion 33*b* at its other end portion, and is pivotably supported at its middle portion by a support block 35, which is fixed to the support plate 7, via a pin 39. In FIG. 5, a front portion of the support block 35 is taken away so that the lock lever 33 is easily viewable. The engaging claw 33*a* of the lock lever 33 extends through a through-hole 18*b* formed in the feed lever 18. A torsion spring (not shown) is provided on the pin 39 on the support block 35, and the lock lever 33 is normally biased, by that torsion spring, against the support block 35 in a counterclockwise direction as viewed in the figure. With the stopper portion 33*b* of the thus-biased lock lever 33 abutting against a stopper portion 35*a* of the support block 35, the lock lever 33 in its free state is held in a posture or position where an end edge of the stopper portion 33*b* is located within the slit 8*a* of the supporting plate 8. In this state, the engaging claw 33*a* of the lock lever 33 engages the center hole 3*a* of the sequin S and the center hole 60*a* of the sequin S2 on the supporting plate 8 as illustrated in FIG. 6(*b*), to thereby lock the continuous sequin strip 3 and the continuous sequin strip 60 against further movement. On the other hand, an edge of the through-hole 18*b* in the feed lever 18 abuts against the lock lever 33, during retracting movement of the feed lever 8, to pivot the lock lever 33 in the clockwise direction against the counterclockwise biasing force of the torsion spring acting on the lock lever 33, as will be described later in detail. In this way, the engaging claw 33*a* is pivoted upwardly disengage from the center hole 3*a* of the sequin S and the center hole 60*a* of the sequin S2.

The support block 35 supporting the lock lever 33 is adjustable in its position, in the front-and-rear direction (the direction in which the continuous sequin strip 3 and the continuous sequin strip 60 are fed on the supporting plate 8) relative to the support plate 7. Thus, the position at which the engaging claw 33*a* of the lock lever 33 engages the center hole 3*a* of the sequin S and the center hole 60*a* of the sequin S2 can be adjusted in accordance with the size of the sequin S and the sequin S2. Note that the support plate 7 as well is adjustable in its position, in the front-and-rear direction (the direction in which the continuous sequin strips 3 and the continuous sequin strip 60 are fed on the supporting plate 8) relative to the mounting base 4.

In the embroidering machine according to the present embodiment, the needle bar case 2 of each machine head is provided with nine needles 31, and the sequin sewing unit 1 is attached to the left side of each of the needle bar cases 2 as noted above. In carrying out the sequin sewing operation, the sequin sewing unit 1 descends to come into an operative state in response to selection of the leftmost needle bar 31, to carry out sequin sewing in conjunction with the needle bar 31.

Next, a description will be given of the sequin feeding operation in accordance with the present embodiment with reference to FIGS. 6 to 10. FIG. 6 shows a state in which one sequin feeding operation cycle has been completed. As stated above, one sequin S and one sequin S2 are projecting forward from the supporting plate 8, and the connecting portions S1(S3) of the sequins are in alignment with the edge of the fixed cutter blade 8*b*. Also, as stated above, the hook portion 18*a* of the feed lever 18 is in engagement with the center hole 3*a* of the sequin S and the center hole 60*a* of the sequin S2, and the engaging claw 33*a* of the lock lever 33 is in engagement with the center holes 3*a* and 60*a* of the second sequins S and S2 from the sequins S and S2 engaged by the hook portion 18*a*.

The machine behaves as follows by virtue of operation of the needle bar 31 descending under such conditions.

Figure 11:
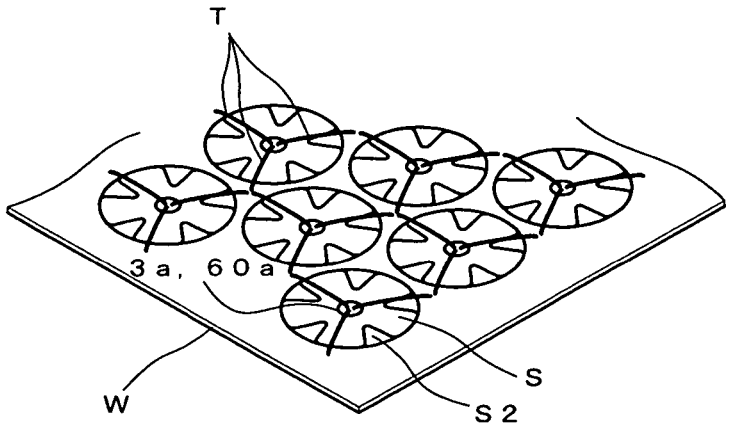
FIG. 11 is a view schematically showing an example of a sequin sewn member produced by the sequin sewing apparatus in accordance with the present invention.

First, a sewing needle 41 (FIG. 3) at the lower end of the needle bar 31 fits into the center hole 3*a* of the leading sequin S and the center hole 60*a* of the leading sequin S2. Then, the needle clamp 32 abuts against and depresses the movable cutter blade 27. Thus, the connecting portion S1 of the leading sequin S of the continuous sequin strip 3 and the connecting portion S2 of the leading sequin S2 of the continuous sequin strip 60 are cut at the same time, so that the leading one set of the sequin S and sequin S2 is cut off in the overlapped state. Thus, the one set of the sequin S and the sequin S2 thus cut off fall onto a to-be-embroidered cloth W (FIG. 3) with the sewing needle 41 still kept fit in the center hole 3*a* and the center hole 60*a*, so that sewing for one stitch is carried out. Thereafter, sewing is carried out a required number of times and in a required pattern through controlled movement of the embroidery frame 51 holding the to-be-embroidered cloth W in accordance with sewing pattern data and vertical movement of the needle bar, so that a plurality of sequins S and S2 are sewn together in the overlapped state onto the cloth W. FIG. 11 shows a sequin sewn member formed in the above described manner. In FIG. 11, "T" denotes a sewing thread.

Figure 7:
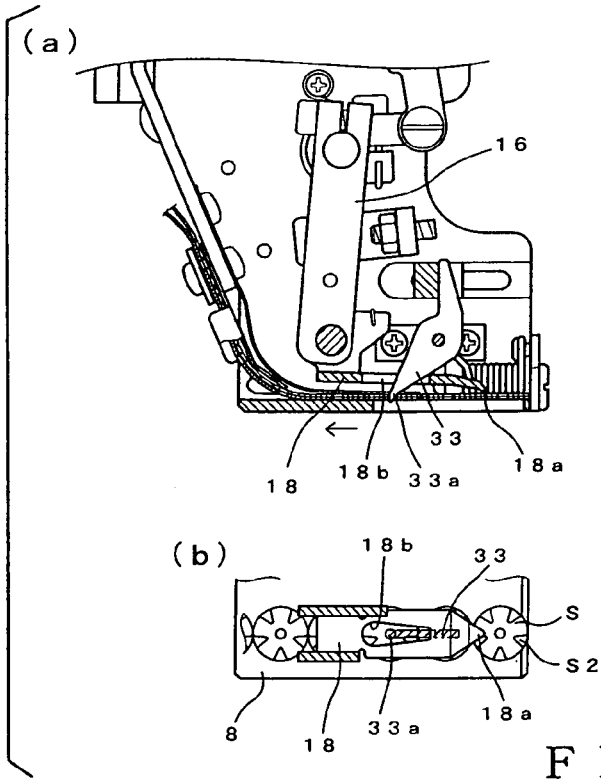
FIG. 7 is a partly-sectional side view and schematic plan view showing the principal sections of the sequin sewing apparatus immediately after a hook portion of the feed lever has exited a center hole of a sequin during rearward movement of the feed lever.
Figure 8:
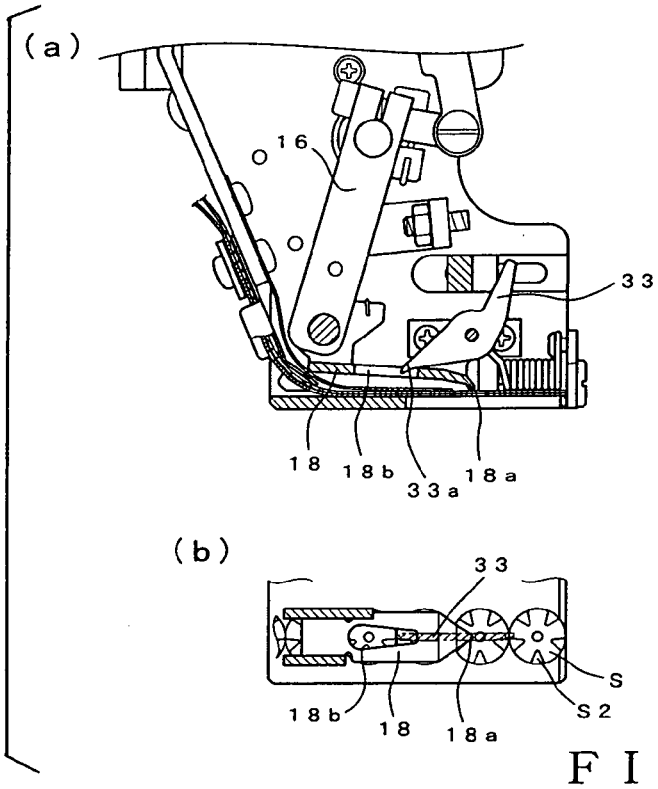
FIG. 8 is a partly-sectional side view and schematic plan view showing the principal sections of the sequin sewing apparatus when the feed lever has moved to a rearwardmost position.

On the other hand, at a suitable time point after the leading sequins S and S2 are cut and before the sewing thereof is completed as stated above, the pivot arm 16 is pivoted in the clockwise direction via the motor 36, so that the feed lever 18 moves backward as shown in FIGS. 7 and 8. FIG. 7 shows the feed lever 18 immediately after the hook portion 18*a* has exited the center hole 3*a* and the center hole 60*a*, in which FIG. 7(*a*) is a partly-sectional side view, and FIG. 7(*b*) is a schematic plan view. Since the engaging claw 33*a* of the lock lever 33 is still kept in engagement with the center hole 3*a* and the center hole 60*a* when the hook portion 18*a* exits the center hole 3*a* and the center hole 60*a*, the continuous sequin strip 3 and the continuous sequin strip 60 can be reliably prevented from being undesirably displaced as the hook portion 18*a* of the feed lever 18 exits the center hole 3*a* and the center hole 60*a*. Further, in the state illustrated in FIG. 7, the edge of the through-hole 18*b* of the feed lever 18 abuts against the lock lever 33. As the feed lever 18 retracts further, the lock lever 33 pivots in the clockwise direction, against the biasing force of the torsion spring, through the engagement with the edge of the through-hole 18*b* of the feed lever 18, so that the engaging claw 33*a* of the lock lever 33 moves upward away from the sequin S and the sequin S2, and is disengaged from the center hole 3*a* of the sequin S and the center hole 60*a* of the sequin S2.

FIG. 8 shows the feed lever 18 having retracted to its rearwardmost position, in which FIG. 8(*a*) is a partly-sectional side view, and FIG. 8(*b*) is a schematic plan view.

Immediately before the state of FIG. 8 is reached, the hook portion 18*a* of the feed lever 18 temporarily fits into and then exits the center hole 3*a* of the sequin S and the center hole 60*a* of the sequin S2; after that, the feed lever 18 assumes the state of FIG. 8. Note that, the continuous sequin strip 3 and the continuous sequin strip 60, having been disengaged from the engaging claw 33*a* of the lock lever 33, are prevented from retracting together with the retracting feed lever 18 during a transitional period from the state of FIG. 7 to the state of FIG. 8; this is owing to the springy resilient force of the holding member 44.

Figure 9:
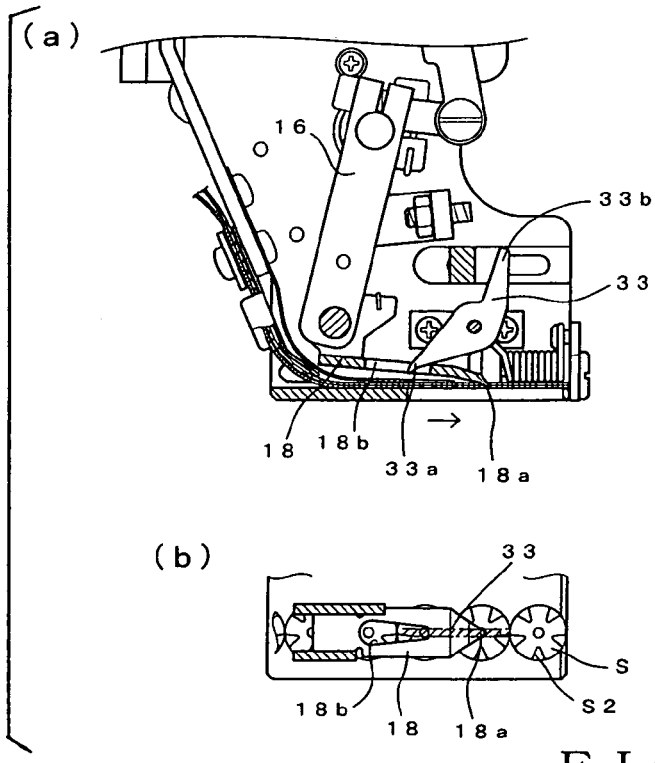
FIG. 9 is a partly-sectional side view and schematic plan view showing the principal sections of the sequin sewing apparatus at a time point when the hook portion of the feed lever has engaged a center hole of a sequin during forward movement of the feed lever.
Figure 10:
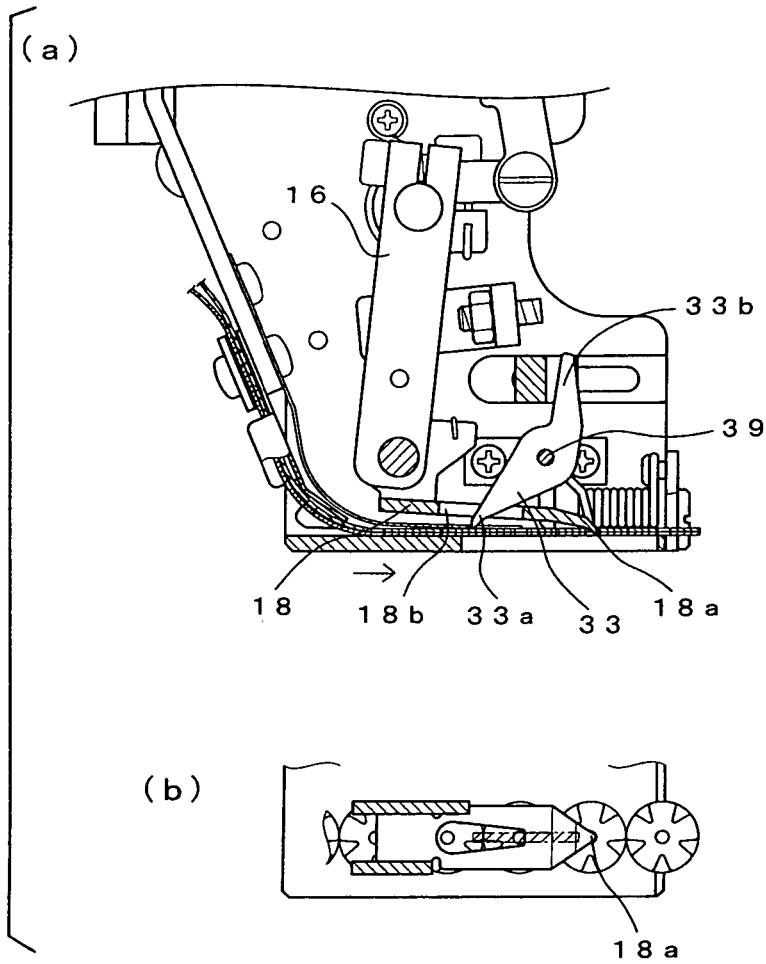
FIG. 10 is a partly-sectional side view and schematic plan view showing the principal sections of the sequin sewing apparatus at a time point when an edge of a through-hole of the feed lever is just about to move away from a lock lever.

After that, on condition that the sewing of the cut sequins S and S2 has been completed, the pivot arm 16 is driven, by the reverse rotation of the motor 36, to pivot in the counterclockwise direction, so that the feed lever 18 moves forward to the position shown in FIG. 6 so as to advance/feed the sequins to be sewn next. FIGS. 9 and 10 show a state of the feed lever 18 during such forward movement. FIG. 9 shows the feed lever 18 at a time point when the hook portion 18*a* has engaged the center hole 3*a* of the sequin S and the center hole 60*a* of the sequin S2 through the forward movement of the feed lever 18, in which FIG. 9(*a*) is a partly-sectional side view, and FIG. 9(*b*) is a schematic plan view. As the feed lever 18 moves forward after that time point, the continuous sequin strip 3 and the continuous sequin strip 60 are fed through forward movement of the hook portion 18*a* engaging the center hole 3*a* and the center hole 60*a*. FIG. 10 shows the lock lever 18 at a point when the edge of the through-hole 18*b* of the advancing feed lever 18 moves away from the lock lever 33, in which FIG. 10(*a*) is a partly-sectional side view, and FIG. 10(*b*) is a schematic plan view. Having been disengaged from the edge of the through-hole 18*b* of the feed lever 18, the lock lever 33 is caused to pivot in the counterclockwise direction by the resilient force of the torsion spring provided on the pin 39. FIG. 10 shows the engaging claw 33*a* of the lock lever 33 having been thus brought into resilient contact with the upper surface of the overlapped sequins S and S2. While the feed lever 18 is advancing further, the engaging claw 33*a* of the lock lever 33 slides on and relative to the upper surface of the overlapped sequins S and S2. Once the feed lever 18 has reached the feeding completion position as shown in FIG. 6, the engaging claw 33*a* of the lock lever 33 engages the center hole 3*a* of the sequin S and the center hole 60*a* of the sequin S2 as stated above.

As stated above, before or after the feeding-out of leading sequins to be sewn next is completed, the embroidery frame 51 is moved to the position at which the next sequins are to be sewn, and then the sequins are cut, and vertical movement of the needle bar and controlled movement of the embroidery frame 51 for sewing are carried out as described above. The sewing operation and the sequin feeding operation as described above are repeated, so that sequin strips comprised of a plurality of sequins S and S2 that are overlapped are sequentially sewn onto the cloth as shown in FIG. 11. By suitably changing shapes, colors, etc. of a plurality of sequins S and S2 sewn in an overlapped state to the cloth as shown in FIG. 11, it is possible to produce a more decorative sequin sewn member than was previously possible. In this case, arranging the sequin sewing apparatus such that the reels 5 and 61 housing the respective continuous sequin strips 3 and 60 can be mounted as in the above described embodiment is advantageous because combinations of a plurality of kinds of sequins to be sewn in an overlapped state to the cloth can be changed with ease. The present invention, however, is not limited to the above described embodiment, but the plurality of continuous sequin strips 3 and 60 may be housed in advance in an overlapped state in one reel 5 or 61.

When the motor 36 is in a non-energized or OFF state, such as when power supply to the embroidering machine is OFF, the pivot arm 16 is held in the feeding completion position shown in FIG. 6, by virtue of the resilient force of the torsion spring 22 on the pivot arm 16, so that the pivot arm 16 is held in abutment against the stopper 25. The motor 36 is a pulse motor that operates under open control, so that it will lose appropriate synchronization if an excessive force acts on the motor 36 during the feed control. For that reason, the motor 36 is temporarily deenergized when the feed lever 18 has reached the forwardmost position, i.e. when the pivot arm 16 has abutted against the stopper 25 upon completion of the feeding cycle. Thus, the motor 36 can be restored to the zero point without fail even when it has lost synchronization; in this way, it is possible to prevent accumulation of positional displacement caused by the synchronization loss.

Finally, a description will be given of an example in which the various components are adjusted when the reel 5 or the reel 61 has been replaced with another one so that the sequins S or the sequins S2 to be sewn are changed to those of a different size. In the case where the size of the sequins S1 or the sequins S2 to be sewn is changed, the changed sizes of the sequins S1 and the sequins S2 have to be the same, because the sequins S1 and the sequins S2 are fed one by one in the overlapped state, to be cut and sewn onto the cloth. Thus, when the size of one sequin is changed, the size of the other sequin has to be changed so that the sizes of those sequins can be the same. In the case where the sizes of the sequins are changed, the adjustments of the components, as set forth in items (1) to (4) below, may be performed concurrently, or in any appropriate order.

(4) Adjustment of Feed Pitch

To adjust the feed pitch, the screw 17 fastening the pivot arm 16 is loosened (see FIGS. 3 and 4) so that the pivot arm 16 can be readily turned with a hand relative to the pivot shaft 15. Further, the stopper 25 is unlocked, and the continuous sequin strips 3 and 61 are played out from the reels 5 and 61, respectively, onto the supporting plate 8 so that the leading sequin S of the strip 3 and the leading sequin S2 of the strip 61 project in the overlapped state beyond the front end edge of the supporting plate 8 as in the "feed completion position" as FIG. 6(*b*). Then, the pivot arm 16 and the feed lever 18 are moved with a hand to cause the hook portion 18*a* of the feed lever 18 to engage the center hole 3*a* of the second sequin S from the leading sequin S and the center hole 60*a* of the second sequin S2 from the leading sequin S2. Then, the stopper 25 is again locked and the screw 17 is tightened with the feeding mechanism, including the pivot arm 16 and feed lever 18, adjusted into the "feed completion position" in accordance with the size of the sequins S and the sequins S2.

(2) Adjustment of Lock Lever

To adjust the lock lever 33, the support block 35 is unlocked. The position of the support block 35 in the front-and-rear direction thereof is adjusted manually to adjust the inclination of the lock lever 33 so that the engaging claw 33*a* of the lock lever 33 engages the center holes 3*a* and 60*a* of the predetermined sequins S and S2 (i.e., the second sequins S and S2 from the sequins S and S2 having been engaged by the hook portion 18*a*) with the stopper portion 33*b* at the upper end of the lock lever 33 being abutted against the stopper portion 35*a* of the support block 35. Then, the support block 35 is again locked with the lock lever 33 positionally adjusted so that the engaging claw 33*a* of the lock lever 33 engages the center holes 3*a* and 60*a* of the predetermined sequins S and S2 as indicated by the "feed completion position" of FIG. 6(*b*).

(3) Positional Adjustment of Sequin Center Holes Relative to Sewing Needle Position Positional adjustment between the sewing needle 41 and the center holes 3*a* and 60*a* of the sequins S and S2 is performed by adjusting the position of the support plate 7 relative to the mounting base 4. Because the support plate 7 is mounted on the mounting base 4 via the forward/rearward guide members, a lock (not shown) provided in association with the guide members is first brought into an unlocking position, so as to allow the support plate 7 to be manually moved in the front-and-rear direction relative to the mounting base 4. Then, the support plate 7 is adjusted so that the center of the center holes 3*a* and 60*a* of the sequins S and S2, having been delivered from the supporting plate 8 to a position where the connecting portion S1 is aligned with the edge of the fixed cutter blade 8*b*, is aligned with the center of the sewing needle 41. Upon completion of the adjustment, the support plate 7 is locked and fixed to the mounting base 4.

(4) Replacement of Guide Section

As necessary, the guide section 12 mounted on the bracket 11 may be replaced with another one that corresponds to the width of the sequins S and S2 newly set on the apparatus in place of the previous sequins.

In the above described embodiment, the motor 36 is disposed in an upper area of the apparatus, and the pivot arm 16 is driven by the motor 36 via the link mechanism, but in an alternative, the pivot arm 16 may be driven directly by the output shaft 40 of the motor 36. Namely, in the alternative, the pivot shaft 15 and follower lever 20 are dispensed with, the motor 36 is fixed to the support plate 7, and the pivot arm 16 is secured to the output shaft 40 of the motor 36.

Furthermore, whereas the above-described embodiment is arranged in such a manner that, during the rearward movement of the feed lever 18, the locking by the lock lever 33 is cancelled after the timing of FIG. 7, the present invention, however, is not limited to this, but it is only necessary that the locking by the lock lever 33 be cancelled at least before the timing of FIG. 8 (i.e., before the feed lever 18 resumes its forward movement). In the case where arrangements are made such that the lock lever 33 is kept in the locking position until the timing of FIG. 8 (i.e., until the feed lever 18 resumes its forward movement), the separate holding member 44 may be dispensed with since the continuous sequin strip 3 can be pressed by the lock lever 33 during rearward movement of the feed lever 18.

Furthermore, although in the above described embodiment, the lock lever 33 is pivoted in the counterclockwise direction by the biasing force of the torsion spring provided on the pin 39 of the support block 36 and pivoted in the clockwise direction by the engagement between the edge of the through-hole 18*b* of the retracting feed lever 18 and the lock lever 33, the present invention is not limited to this, but any other suitable arrangements may be employed. For example, the spring employed as the biasing means may be other than the torsion spring, and the biasing means may include an electric or electronic or mechanical drive means other than the spring.

According to the above described embodiment, the engaging claw 33*a* of the lock lever 33 engages the center holes 3*a* and 60*a* of the sequins S and S2 at a time point when the feeding-out of the leading sequins has been completed. Thus, even when an unexpected tensile force acts on the sequins S and S2 before the sequins S and S2 are severed after the sewing needle 41 has fitted in the center holes 3*a* and 60*a* of the fed-out sequins S and S2, the continuous sequin strips 3 and 60 can be prevented from being undesirably pulled out; consequently, the sequins S and S2 can be cut in the connecting portions S1 and S3 thereof without fail, and thus, the sequins S and S2 are reliably prevented from being cut into a distorted shape.

Further, at the time point when the feeding-out of the leading sequins has been completed, the hook portion 18*a* of the feed lever 18 and the engaging claw 33*a* of the lock lever 33 both engage the center holes 3*a* and 60*a* of the sequins S and S2, so that the continuous sequin strips 3 and 60 can be positionally regulated at two points thereof in its longitudinal direction (i.e., feeding direction). As a result, the sequins S and S2 can be positionally adjusted in their widthwise direction at least upon completion of each sequin feeding cycle. Therefore, there is no need to provide a particular guide member on the supporting plate 8 for positionally regulating the continuous sequin strips 3 and 60.

Although in the above described embodiment, the sequin sewing apparatus overlaps two continuous sequin strips to produce a sequin sewn member in which two sequins are overlapped, the present invention is not limited to this, but it goes without saying that the sequin sewing apparatus may be arranged to produce a sequin sewn member in which an arbitrary number of sequins are overlapped; for example, the sequin sewing apparatus may be arranged to be capable of overlapping three continuous sequin strips to produce a sequin sewn member in which three sequins are overlapped. In this case, for example, three or more reels (5 and 61) that house respective continuous sequin strips may be mounted on the sequin sewing apparatus. Alternatively, at least one of a plurality of reels (5 and 61) that houses a plurality of overlapped continuous sequin strips in advance may be used, and one or more continuous sequin strips let out from the reels 5 and 61 may be overlapped again by the lead-in section 63.

Further, in the present invention, a plurality of continuous sequin strips (5 and 61) supplied in the overlapped state should not necessarily be comprised of different kinds (e.g., color and shape) of sequins as in the above described embodiment, but may be comprised of the same kind (e.g., color and shape) of sequins.

Further, the sizes of sequins to be overlapped should not necessarily be the same. For example, the size of one sequin may be an integral multiple of the size of the other sequin. For example, the diameter of sequins on the upper side is set to be half the diameter of sequins on the lower side, and each larger-diameter sequin is formed with a plurality of holes through which threads are to be passed in accordance with the positions of holes of each smaller-diameter sequin through which threads are to be passed. In this case, a predetermined pitch at which continuous sequin strips are fed is determined in accordance with the diameter of the larger-diameter sequins, and the larger-diameter sequins are cut one by one whereas a plurality of smaller-diameter sequins are cut at a time (for example, by twos). Thus, in the present invention, the word "sequin" does not necessarily refer to only one sequin, but means one piece cut off from a continuous sequin strip.

What is claimed is:

1. A sequin sewing apparatus comprising:

a supplying section that supplies a plurality of continuous sequin strips, each comprising a multiplicity of continuously-connected sequins, in an overlapped state;

a feeding mechanism that feeds the plurality of continuous sequin strips supplied in the overlapped state by said supplying section a predetermined pitch at a time in interlocked relation to predetermined sewing operation;

a sewing mechanism that sews leading sequins of the plurality of continuous sequin strips fed by said feeding mechanism in the overlapped state onto a sewn-to member; and a cutting mechanism that cuts off the leading sequins sewn by said sewing mechanism from the respective continuous sequin strips, wherein the sequins of each of the continuous sequin strips have holes, and wherein positions of the holes of the sequins are aligned in the overlapped state to permit the feeding mechanism to engage the holes of the aligned sequins to sequentially feed the plurality of continuous sequin strips at the predetermined pitch at a time in interlocked relation to predetermined sewing operation.

2. A sequin sewing apparatus according to claim 1, wherein said supplying section comprises a reel mounting section on which a plurality of reels housing respective continuous sequin strips are to be mounted, and a lead-in section that overlaps the respective continuous sequin strips let out from the reels mounted on said reel mounting section.

3. A sequin sewing apparatus according to claim 2, wherein said lead-in section leads the plurality of continuous sequin strips, let out from the respective reels, in the overlapped state to a guide section, and the guide section guides the continuous sequin strips to said feeding mechanism while inhibiting the continuous sequin strips from being separated from each other.

4. A sequin sewing apparatus according to claim 1, wherein said supplying section comprises a reel mounting section on which a reel that houses a plurality of continuous sequin strips in an overlapped state is to be mounted.

5. A sequin sewing apparatus comprising:

a supplying section that supplies a plurality of continuous sequin strips, each comprising a multiplicity of continuously-connected sequins, in an overlapped state;

a feeding mechanism that feeds the plurality of continuous sequin strips supplied in the overlapped state by said supplying section a predetermined pitch at a time in interlocked relation to predetermined sewing operation;

a sewing mechanism that sews leading sequins of the plurality of continuous sequin strips fed by said feeding mechanism together in the overlapped state onto a sewn-to member; and a cutting mechanism that cuts off the leading sequins sewn by said sewing mechanism from the respective continuous sequin strips, wherein said feeding mechanism feeds the plurality of continuous sequin strips, placed in the overlapped state on an upper surface of a supporting plate, a predetermined pitch at a time in interlocked relation to predetermined sewing operation and through forward and rearward movement of a feed lever, said feeding mechanism feeding the continuous sequin strips by moving the feed lever forward with a distal-end hook portion of the feed lever engaging holes of sequins.

6. A sequin sewing apparatus according to claim 5, wherein the holes of the sequins are holes through which a thread is to be passed, and positions of the holes of the sequins in the overlapped state correspond to each other.

7. A sequin sewing apparatus according to claim 1, wherein the plurality of continuous sequin strips supplied in the overlapped state by said supplying section comprise different kinds of sequins.

8. A sequin sewing apparatus according to claim 1, wherein the plurality of continuous sequin strips supplied in the overlapped state by said supplying section comprise the same kind of sequins.

9. A sequin sewing apparatus according to claim 1, wherein said feeding mechanism feeds the continuous sequin strips the predetermined pitch in synchronization with timing of sewing of one sequin.

10. A sequin sewing apparatus according to claim 1, wherein said cutting mechanism cuts leading sequins at a time from the plurality of continuous sequin strips fed by said feeding mechanism in interlocked relation to sewing operation of said sewing mechanism.

11. A sequin sewing apparatus according to claim 1, wherein the sequin sewing apparatus comprises an embroidering machine, said sewing mechanism is a sewing mechanism of said embroidering machine, and the sequin sewing apparatus is constructed by attaching a sequin sewing unit comprising said supplying section, said feeding mechanism, and said cutting mechanism to said embroidering machine.

* * * * *

UNITED STATES PATENT AND TRADEMARK OFFICE

CERTIFICATE OF CORRECTION

PATENT NO. : 7,293,512 B2
APPLICATION NO. : 10/567140
DATED : November 13, 2007
INVENTOR(S) : Ikuo Tajima et al.

It is certified that error appears in the above-identified patent and that said Letters Patent is hereby corrected as shown below:

Title Page;
In section (30) Titled "Foreign application Priority Data" the Foreign Application Number should read as follows:

--Aug. 7, 2003 (JP) ……..2003-289429--

Signed and Sealed this

Twelfth Day of August, 2008

JON W. DUDAS
*Director of the United States Patent and Trademark Office*